US005922409A

United States Patent [19]

McMordie et al.

[11] Patent Number: 5,922,409

[45] Date of Patent: Jul. 13, 1999

[54] METHOD FOR FORMING A COATING SUBSTANTIALLY FREE OF DELETERIOUS REFRACTORY ELEMENTS ON A NICKEL- AND CHROMIUM-BASED SUPERALLOY

[75] Inventors: Bruce G. McMordie, Perkasie; Thomas A. Kircher, Abington, both of Pa.

[73] Assignee: Sermatech International, Inc., Limerick, Pa.

[21] Appl. No.: 08/802,661

[22] Filed: Feb. 19, 1997

Related U.S. Application Data

[62] Division of application No. 08/202,352, Feb. 28, 1994, Pat. No. 5,650,235.

[51] Int. Cl.[6] ..... B05D 3/02

[52] U.S. Cl. ..... 427/383.7; 427/405; 427/427

[58] Field of Search ..... 427/383.7, 405, 427/427

[56] References Cited

U.S. PATENT DOCUMENTS 5,492,726 2/1996 Rose et al. ..... 427/252

FOREIGN PATENT DOCUMENTS

WO 93/23247 11/1993 WIPO .

*Primary Examiner*—Katherine A. Bareford
*Attorney, Agent, or Firm*—Weiser and Associates, P.C.

[57] ABSTRACT

The oxidation and corrosion resistance of a nickel-base alloy are enhanced by a process which includes first enriching the surface of an alloy substrate with platinum, as by electrolytic deposition, and then simultaneously diffusing aluminum and silicon from a molten state into the platinum-enriched substrate. The invention further provides coatings and coated substrates with enhanced oxidation and corrosion resistance.

35 Claims, 12 Drawing Sheets

METHOD FOR FORMING A COATING SUBSTANTIALLY FREE OF DELETERIOUS REFRACTORY ELEMENTS ON A NICKEL- AND CHROMIUM-BASED SUPERALLOY

This is a division of application Ser. No. 08/202,352, filed Feb. 28, 1994, now U.S. Pat. No. 5,650,235.

BACKGROUND OF THE INVENTION

This invention relates to the simultaneous incorporation of silicon and aluminum into nickel alloy surfaces that have been enriched in platinum, to produce a uniquely protective coating with significantly improved resistance to hot corrosion and oxidation than that which can be achieved by additions of either silicon or platinum alone. The coating comprises platinum and nickel aluminide phases that are relatively free of substrate elements, particularly refractory metals, which hinder performance, said elements being concentrated within silicide compounds which contribute to the overall corrosion resistance of the coating layer.

During operation, components in the hot section (or power turbine section) of a gas turbine are exposed to temperatures that can reach 1200° C. These components are typically made of nickel and cobalt base alloys specially fabricated for high temperature use. Even so, upon exposure to service at such high temperatures, these heat resistant materials begin to revert to their natural form, metal oxides and/or sulfides. Nickel and cobalt oxides are not tightly adherent. During thermal cycling, they crack and spall off the surface exposing more substrate to the environment. In this manner, oxidation roughens and eventually consumes unprotected parts made of these alloys (see FIG. 1).

Sodium, chlorine and sulfur in the operating environment speed degradation. Above about 540° C., sodium reacts with sulfur-containing compounds to form molten sulfates which condense on the metal parts, dissolving the loosely adherent films of nickel and cobalt oxide and attacking the substrate (see FIG. 2).

The chemistry of high-temperature superalloys was initially optimized for high-temperature strength. Refractory elements such as molybdenum, tungsten and vanadium were added to enhance high-temperature strength of nickel-base alloys. However, it became apparent with time that these same refractory elements, though beneficial for alloy strength, seriously reduced high-temperature corrosion resistance. It became necessary to modify alloy chemistries for service in corrosive environments by increasing levels of chromium, which has a beneficial effect on alloy corrosion resistance. Chromium, however, reduces the high temperature strength of nickel-base superalloys.

One means to enhance oxidation and hot corrosion resistance of nickel and cobalt superalloys, widely known in the art and practiced in gas turbine engines, is to alloy aluminum into the surface of the parts. Aluminum forms stable intermetallic compounds with both nickel and cobalt. When the concentration of aluminum in these phases is sufficiently high, the oxide scale which forms at high temperature is no longer a loosely adherent base metal oxide, but a tough, tightly adherent, protective layer of alumina ($Al_2O_3$) (see FIG. 3).

Wachtell et al., U.S. Pat. No. 3,257,230, and Boone et al., U.S. Pat. No. 3,544,348, are among those who have described methods of forming these protective layers of intermetallic aluminide from an aluminum vapor in a process known as "pack" aluminizing. Aluminum or aluminum alloy powders are mixed with inert powder (usually alumina) and halide compounds known as activators. When heated to sufficiently high temperatures (650° C. or more), the halides react with the aluminum to form gaseous aluminum halides. These vapors condense on the metal surface, where they are reduced to elemental aluminum. These aluminum atoms diffuse into the substrate to form protective intermetallic aluminide phases—NiAl and $Ni_2Al_3$ on nickel alloy substrates and CoAl and $Co_2Al_5$ on cobalt alloys.

Joseph, U.S. Pat. No. 3,102,044 describes, how a protective layer of intermetallic aluminides may be produced from liquid phase reactions of a metal-filled coating on the surface of a part. In this process, known as slurry aluminizing, a layer of aluminum metal is deposited on the hardware, then the part is heated in a protective atmosphere. When the temperature exceeds the melting temperature of aluminum (660° C.), the aluminum metal on the surface melts and reacts with the substrate. NiAl forms directly, avoiding formation of higher aluminum content intermetallics.

One commercial slurry aluminizing coating method used in the aircraft industry, specifies that aluminum be deposited on the surface before diffusion by means of thermal spray or application of a metal-filled slurry or paint. One slurry used is an aluminum-filled chromate/phosphate slurry such as that described in Allen, U.S. Pat. No. 3,248,251. This slurry consists of aluminum powders in an acidic water-based solution of chromates and phosphates. The slurry can be applied by brush or conventional spray methods. When heated at a temperature of about 260° C. to 540° C. (500° F. to 1000° F.) , the binder transforms to a glassy solid which bonds the metal powder particles to one another and the substrate.

It has been found that when a slurry coated superalloy part is heated to temperatures of about 980° C. (1800° F.), the aluminum powder melts and diffuses into the part to produce a protective aluminide, that is, NiAl on a nickel alloy and CoAl on a cobalt alloy. Because the ceramic binder is stable at the processing temperatures, the aluminum powder is firmly held against the substrate as diffusion proceeds. Deadmore et al., U.S. Pat. No. 4,310,574, describes a means to enhance hot corrosion resistance of an aluminide by simultaneously incorporating silicon into the surface during aluminization. In this patent, a silicon-filled organic slurry is sprayed onto a part which is then placed into a pack mixture of aluminum and activators. During heating, aluminum condensing on the surface carries silicon with it as it diffuses into the substrate. It was shown that the resulting silicon-enriched aluminide was more resistant to oxidation at 1093° C. (2000° F.) than were aluminides without silicon.

Another means for adding silicon to an aluminide coating, which predates the Deadmore '574 patent, is to simultaneously melt and alloy aluminum and silicon into the surface. An aluminum and silicon-filled slurry available commercially under the tradename SermaLoy® J (Sermatech International, Limerick, Pa., U.S.A.), has been used for many years to repair imperfections and touch up parts coated with pack aluminides and MCrAlY overlay coatings. In SermaLoy® J slurry, aluminum and silicon powders are dispersed in a chromate/phosphate binder of the type described in the Allen '251 patent.

As supplied for use, the SermaLoy® J slurry coating composition comprises silicon and aluminum elemental metallic powders in an acidic water solution of inorganic salts as a binder. About 15% by weight of the total metallic powder content of the slurry is silicon powder. However, the overall composition of the slurry in approximate weight percentages is:

Al powder—35%

Si powder—6%

Water—47%

Binder salts (dissolved in the water)—12%

A preferred mode of preparation of the composition is to premix the metallic powder constituents and make the binder solution separately, then mix the powder into the solution. Other ways of preparing the composition can readily be devised.

This binder is selected to cure to a solid matrix which holds the metal pigments in contact with the metal surface during heating to the diffusion temperature. It also is selected to be fugitive during diffusion to yield residues that are only loosely adherent to the surface after diffusion has been completed.

When a nickel alloy coated with SermaLoy® J slurry is heated to 870° C. (1600° F.), aluminum powder in the slurry melts, silicon powder dissolves into this molten aluminum and both species diffuse into and alloy with the substrate.

The intermetallic phases that result are formed by inward diffusion of these metals. Diffusion is biased by the different affinities of the diffusing species for elements in the substrate. On nickel alloys, aluminum reacts with nickel while silicon segregates to chromium and other refractory elements. The result is a composite coating of beta-phase nickel aluminide (NiAl) and chromium silicides ($Cr_xSi_y$). The unique layered structure of this composite coating on a Waspaloy® nickel superalloy substrate is shown in FIG. 4. Layering of nickel, chromium, silicon, aluminum and cobalt phases within this structure is shown in the electron microprobe maps in FIGS. 5*a–e*.

Engine experience and laboratory testing affirm that this aluminide-silicide coating is more resistant to sulfidation and hot corrosion than aluminides not modified with silicon in this manner. Silicides in these slurry aluminides are especially resistant to attack by molten sulfates, so the layers (in FIG. 4) act as barriers to hot corrosion.

However, it has been found that the corrosion resistance of silicon-modified slurry aluminide coatings depends upon the chromium content of the underlying substrate metal. In laboratory burner rig tests, the performance of a silicon-modified coating on IN738, which contains about 16% chromium, is significantly better than that of the same coating on IN100, a nickel alloy containing about 10% chromium. The hot corrosion life of a SermaLoy® J coating was 300–350 hours/mil (12–14 hrs/$\mu$m) when tested on IN738. The corrosion life of the coating was only 150–200 hrs/nil (6–8 hrs/$\mu$m) on IN100.

Bungardt et al. (U.S. Pat. Nos. 3,677,789 and 3,819,338) show that hot corrosion and oxidation resistance of diffused aluminides may be enhanced by incorporating metals of the platinum group. At least 3 to 7 $\mu$m of platinum is electroplated onto a nickel surface. The platinum layer is diffused into the substrate by pack aluminization at temperatures of about 1100° C. to form a protective diffusion layer on the surface. When the platinum-coated surface is aluminized in a pack, a portion of intermetallic aluminides which form are platinum-aluminides (PtAl and $PtAl_2$) rather than nickel-aluminides. The aluminum oxide scale that forms on such a mixture of platinum and nickel aluminides is tougher and more adherent than the scale that forms on nickel aluminides alone.

Others in addition to Bungardt have capitalized upon the performance improvement expected due to replacing some portion of the nickel aluminide in a high temperature coating with platinum aluminides. Stueber et al. (U.S. Pat. Nos. 3,999,956 and 4,070,507), for example, shows that the benefits of platinum can be augmented by incorporating rhodium into the aluminide as well. Panzera et al. (U.S. Pat. No. 3,979,273) describes how these benefits might be realized by alloying thinner deposits of platinum with active elements like Y, Zr or Hf. Shankar et al. (U.S. Pat. No. 4,526,814) describe protective aluminides formed by diffusing chromium and platinum into nickel surfaces before aluminizing. The chromium improves the corrosion resistance of the nickel aluminide phase, thereby substantially improving the overall performance of the platinum-modified aluminide.

Creech et al. (U.S. Pat. No. 5,057,196) describe a method for improving mechanical properties of platinum modified aluminide coatings. In their method, a platinum-silicon alloy powder is electrophoretically deposited on the surface, then heated to a sufficient temperature to melt the alloy powder and initiate diffusion of the platinum and silicon into the nickel substrate. Subsequently, aluminum-chromium powder is diffused through this platinum-silicon-nickel alloy layer to produce an aluminide coating. The patent indicates that incorporating silicon into the coating by co-diffusing with platinum improves ductility over such a coating without silicon.

Despite advancements and modifications to diffusion aluminide coating processes, the high-temperature corrosion performance of current coatings of this type is generally affected by substrate alloy chemistry. A diffusion aluminide coating applied on an alloy substrate optimized for high-temperature corrosion resistance (that is, high chromium content) will perform significantly better than the same coating applied on an alloy substrate with poor high-temperature corrosion resistance (that is, low chromium contact). This inherent limitation of current practice restrains the utilization of stronger or less expensive alloys (with correspondingly lower chromium contents) from applications where high-temperature corrosion is prevalent, such as marine gas turbines and offshore power generation.

Background technical articles of interest are the following. The benefits of silicon-based coatings have been described by F. Fitzer and J. Schlicting in their paper "Coatings Containing Chromium, Aluminum and Silicon" for National Association of Corrosion Engineers held Mar. 2–6, 1981 in San Diego, Calif., and published as pages 604–614 of "High Temperature Corrosion", (Ed. Robert A. Rapp). Details of testing of rotor blade materials and coatings have been published by the American Society of Mechanical Engineers (ASME) in a paper by R. N. Davis and C. E. Grinell entitled "Engine Experience of Turbine Materials and Coatings (1982). Also see "Protective Coatings For High Temperature Alloys State of Technology", by G. William Goward, from "Proceedings of the Electrochemical Society, Vol 77-1", "Strengthening Mechanisms in Nickel-Base Superalloys", by R. F. Decker, presented at the Steel Strengthening Mechanisms Symposium in Zurich, Switzerland on May 5th and 6th, 1969, and "High Temperature High Strength Nickel Base Alloys", a publication of International Nickel, Inc. of SaddleBrook, N.J. All of these publications are incorporated herein by reference.

SUMMARY OF THE INVENTION

In accordance with the present invention there is provided a method of coating the surface of a nickel-base alloy substrate to enhance the oxidation and corrosion resistance of the substrate. In the method of the present invention, the surface of a nickel-base alloy substrate is first enriched with platinum by depositing a layer of platinum on the surface and then heating the platinum-coated surface to diffuse the platinum into the substrate. Then aluminum and silicon are simultaneously diffused from a molten state into the platinum-enriched substrate. This coating method forms a platinum-enriched silicon-modified corrosion and oxidation resistant aluminide coating on the nickel-base alloy substrate.

The present invention also provides a novel platinum-enriched silicon-modified aluminide coating for nickel-base alloy substrates. In a preferred embodiment of the present invention, the coating comprises a continuum of nickel aluminide in at least three distinguishable layers. The surface layer of the coating includes a dispersed distribution of platinum aluminide and refractory silicide phases in the nickel aluminide. Below the surface layer is a second layer which has a dispersed distribution of refractory silicide phases in the nickel aluminide, and which is relatively free of platinum aluminide phases as compared to the surface layer. Below the second layer is a third layer which is relatively free of both platinum aluminide and refractory silicide phases as compared to the surface layer. This coating provides improved resistance to oxidation and hot corrosion conditions.

The invention further provides a refractory-containing nickel-base superalloy part coated with the platinum-enriched silicon-modified coating of the present invention.

The coating methods and coatings of the present invention may also be applied to cobalt-base alloys to provide improved oxidation and corrosion resistance, in the same manner as for nickel-base alloys.

BRIEF DESCRIPTION OF THE FIGURES

Examples of the present invention and its background are illustrated with reference to the accompanying drawings, in which.

DETAILED DESCRIPTION OF THE INVENTION

The coatings of this invention combine the benefits of platinum in platinum-enriched diffused aluminides with those of suicides produced in silicon-modified slurry aluminides. Synergies of the two mechanisms produce a coating that is more protective than either method or coating individually.

In a preferred embodiment of the coating of this invention, a slurry comprising aluminum powder and silicon powder is diffused into the surface of a nickel alloy which has been enriched in platinum. The slurry is diffused above 660° C. (1220° F.) in a non-reactive environment, whereupon the aluminum powder melts and dissolves the silicon. Aluminum diffusing into the substrate from this molten slurry, reacts with nickel and platinum to form intermetallic aluminides with nickel (NiAl) and platinum ($PtAl_2$) known to be very stable and resistant to hot corrosion.

As it diffuses from the molten slurry, silicon reacts to form stable silicides with refractory metals, such as chromium, molybdenum, vanadium, titanium and tungsten in the nickel alloy substrate. Also included among the refractory elements for purposes of the present invention are niobium, tantalum, hafnium and rhenium. These elements are added to strengthen nickel superalloys. However, some of these refractory metals, particularly tungsten, vanadium and molybdenum, reduce resistance of the alloy to hot corrosion. Refractory metal oxides expand upon formation, disrupting the protective alumina scale. Furthermore, these elements can initiate a self-propagating form of hot corrosion.

However, silicon scavenges these strengthening elements from the platinum and nickel aluminide phases, incorporating them in stable, corrosion resistant suicides. This cleansing of the aluminide phases enhances adherence of the protective scale on the coating of this invention. Moreover, the resulting corrosion resistant silicides augment resistance to hot corrosion.

Figure 1:
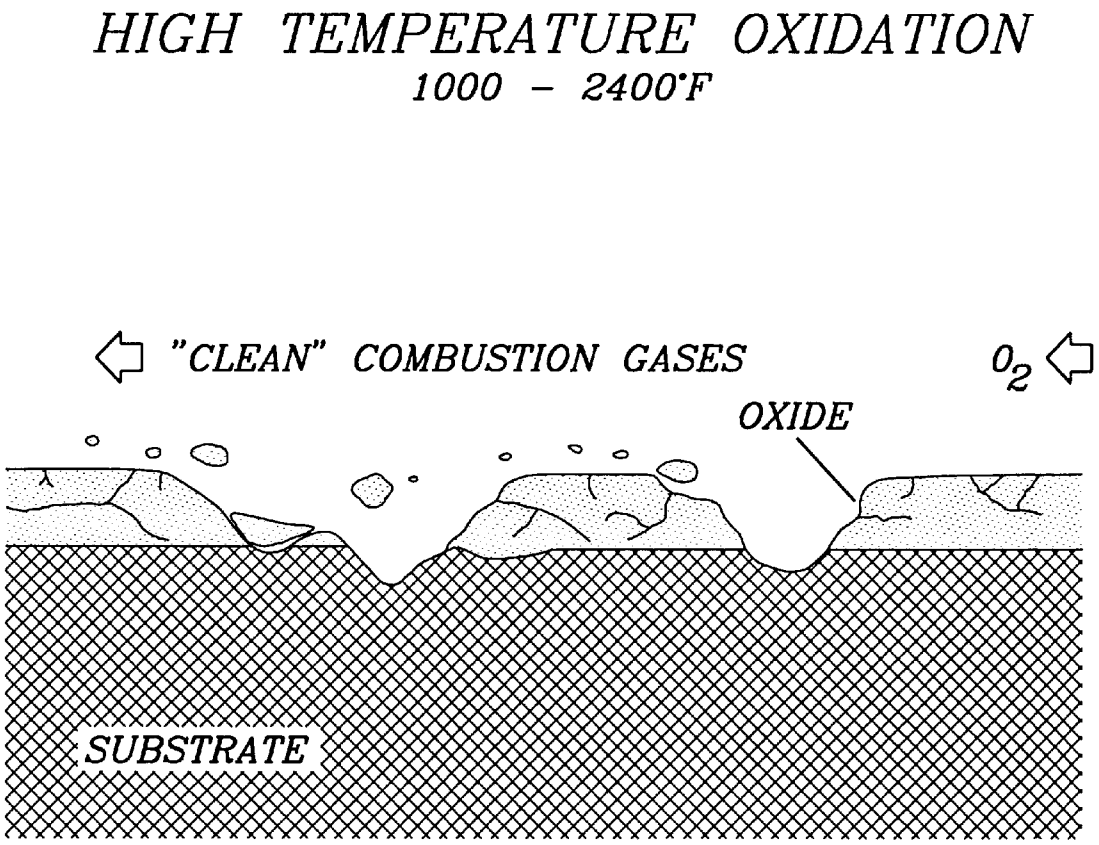
FIG. 1 is a pictorial representation of what occurs when a typical substrate of an unprotected superalloy surface is exposed to clean combustion gases.
Figure 2:
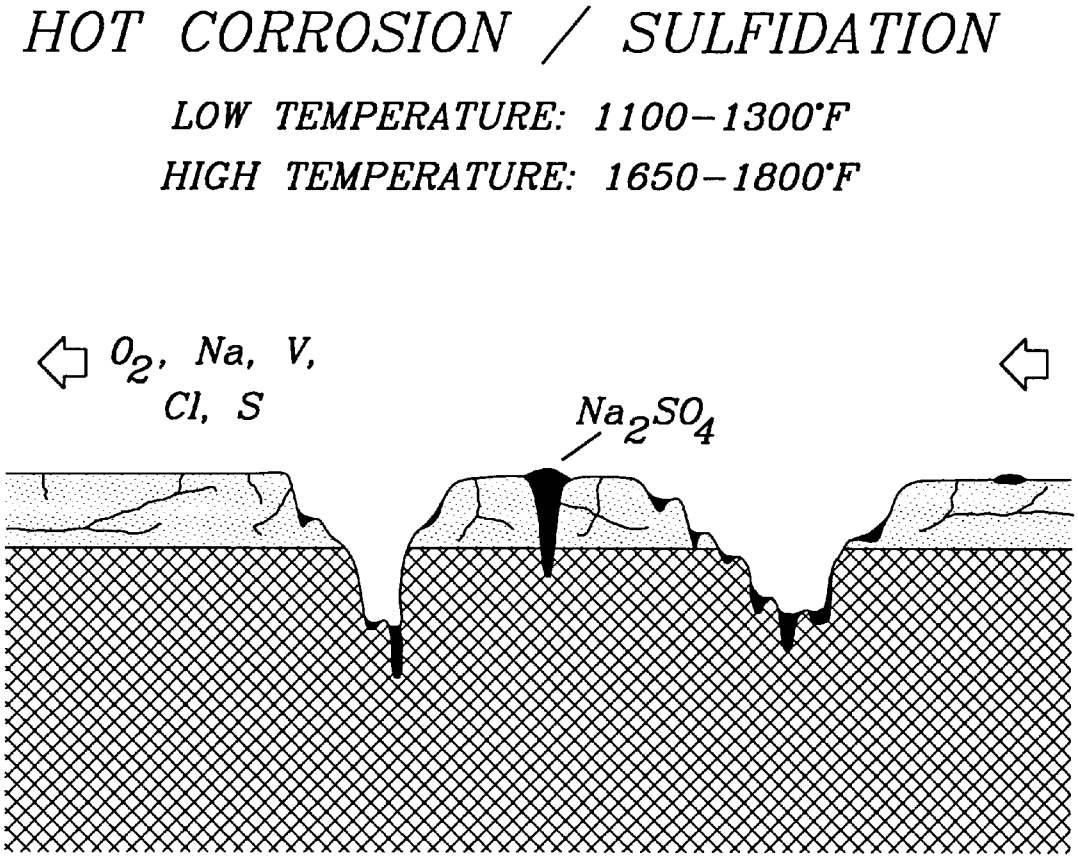
FIG. 2 is a pictorial representation of what occurs when a typical substrate of an unprotected superalloy surface is exposed to combustion gases containing contaminants which contain chlorine and sulfur frequently found in marine environments under condition of hot corrosion/sulfidation.
Figure 3:
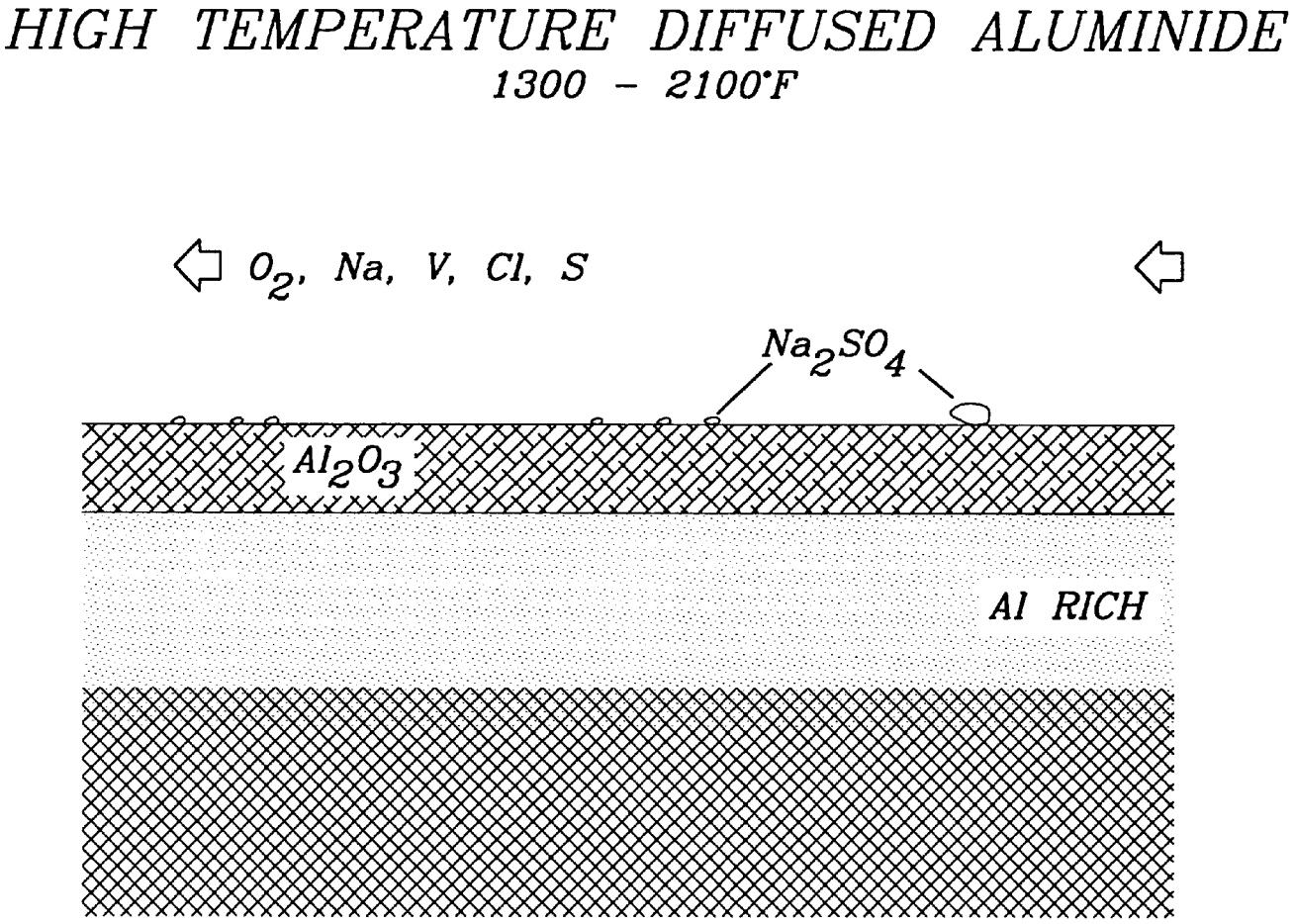
FIG. 3 is a pictorial representation which shows a typical superalloy substrate which has been aluminized to form a diffused aluminide coating, with a highly adherent protective layer of alumina, $Al_2O_3$.
Figure 4:
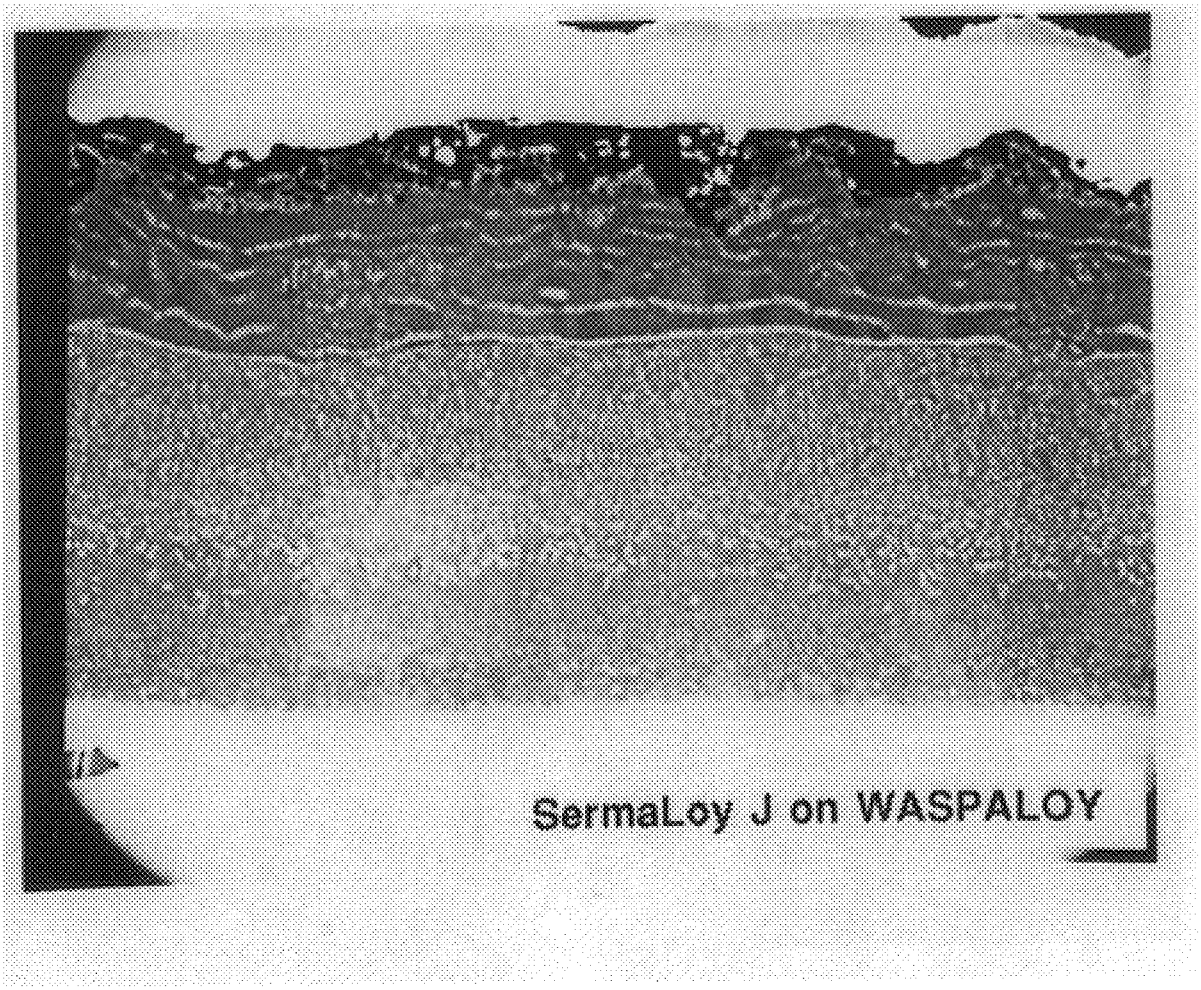
FIG. 4 is a photomicrographic view of a silicon-modified slurry aluminide (SermaLoy® J) on Waspaloy® nickel alloy.
Figure 5A:
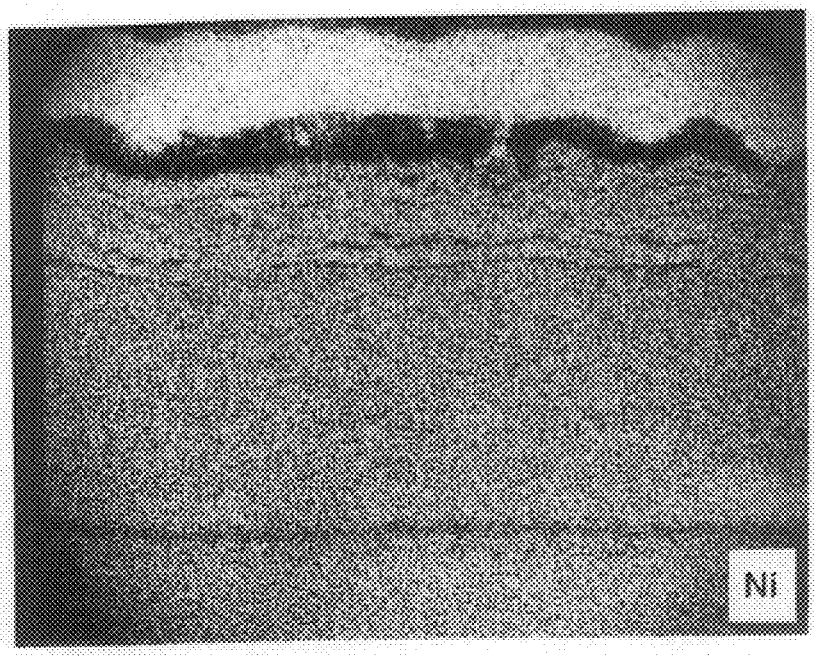
FIGS. 5*a*, 5*b*, 5*c*, 5*d* and 5*e* are electron microprobe maps showing the distribution of the elements nickel, aluminum, chromium, silicon and cobalt, respectively, in the coating microstructure presented in FIG. 4.
Figure 5B:
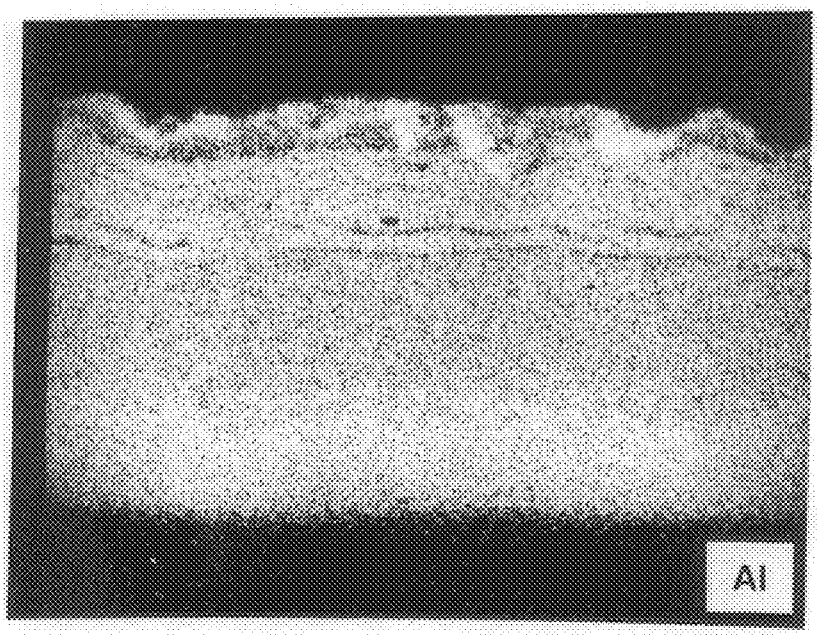
Figure 5C:
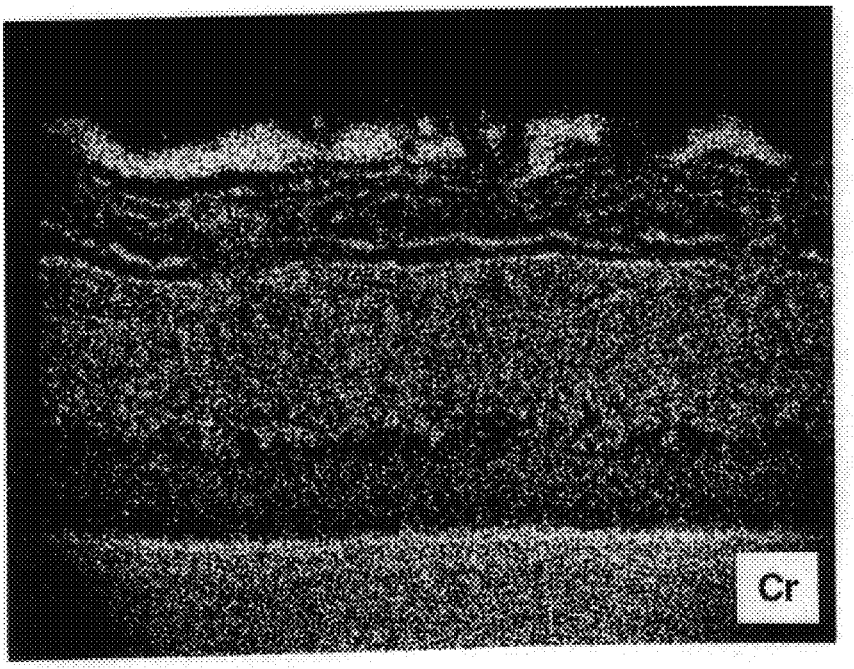
Figure 5D:
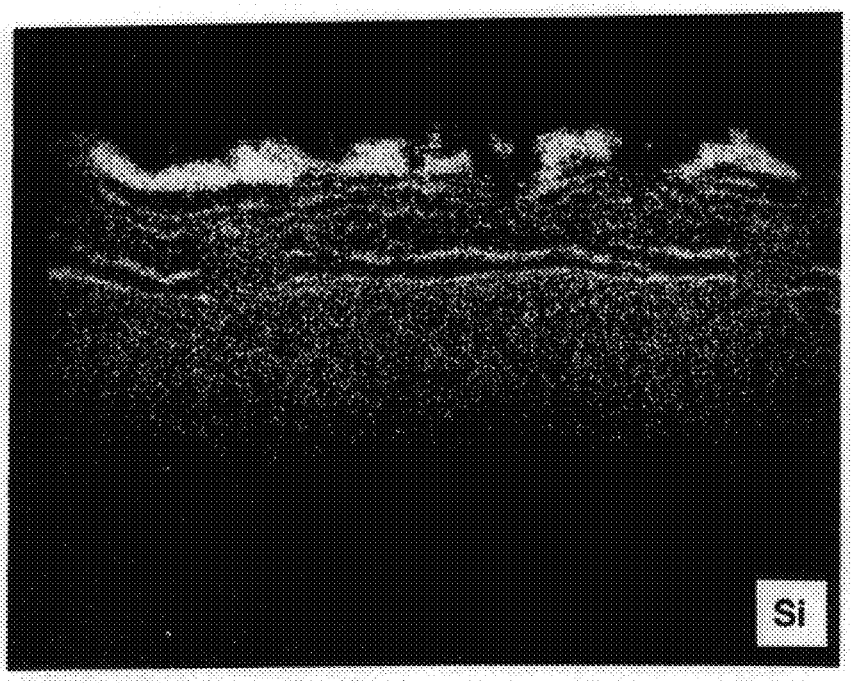
Figure 5E:
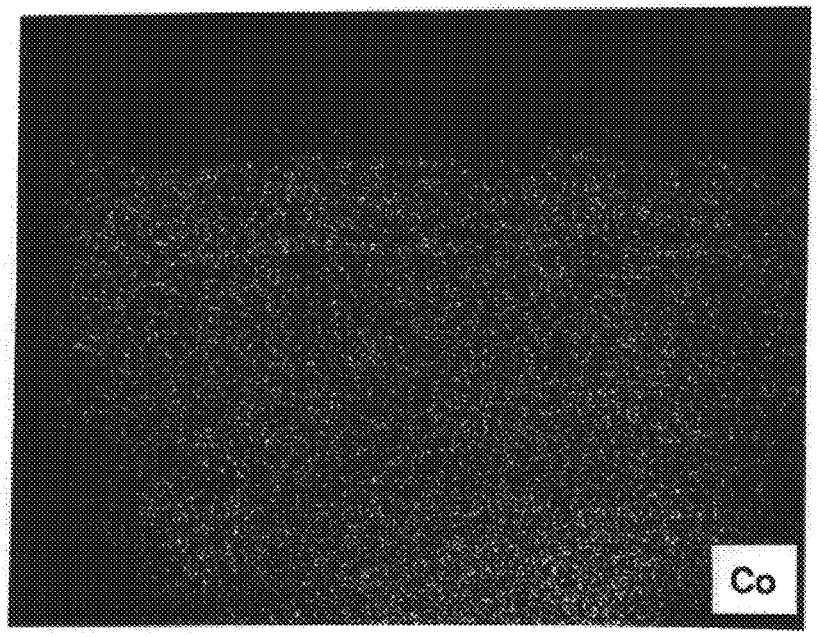
Figure 6:
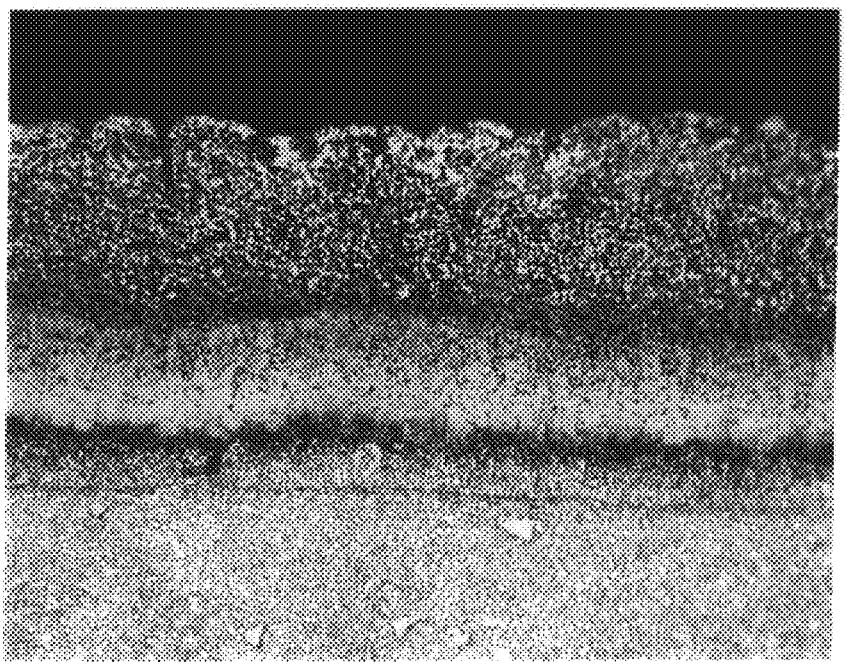
FIG. 6 is a photomicrograph of a platinum-enriched silicon-modified slurry aluminide coating on IN100 (shown acid etched at 500× magnification) made in accordance with the present invention. In the outer third of the coating (region A) $PtAl_2$ (white or light etching phase) and silicides of Ti, W, Mo and V (dark phases) are dispersed in an NiAl (gray) matrix. Beneath this layer is a region (B) consisting of silicides dispersed in NiAl. The band of light etching material (region C) near the substrate consists of NiAl that is relatively free of any Pt- or Si-rich phases.
Figure 7:
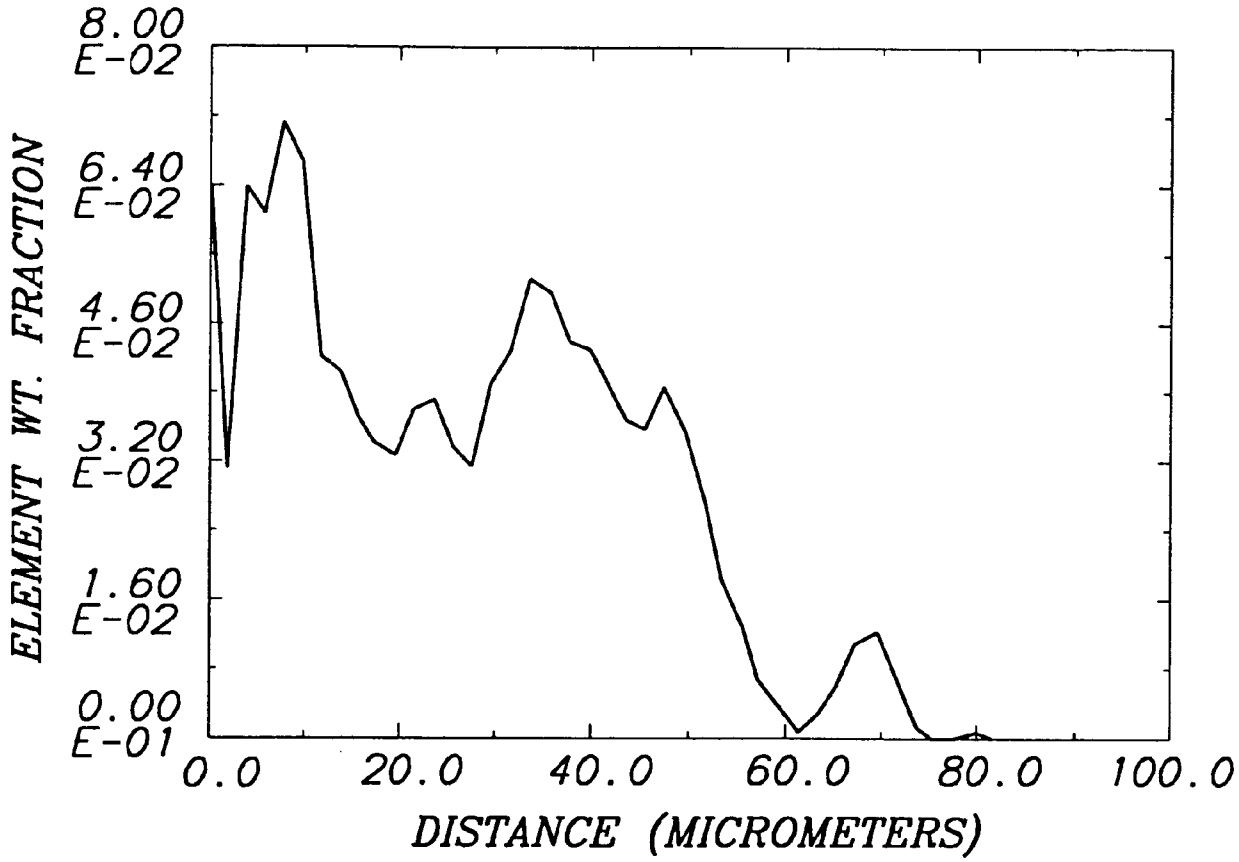
FIG. 7 shows an electron microprobe trace of the distribution of silicon (Si) in the coating of this invention shown in FIG. 6.
Figure 8:
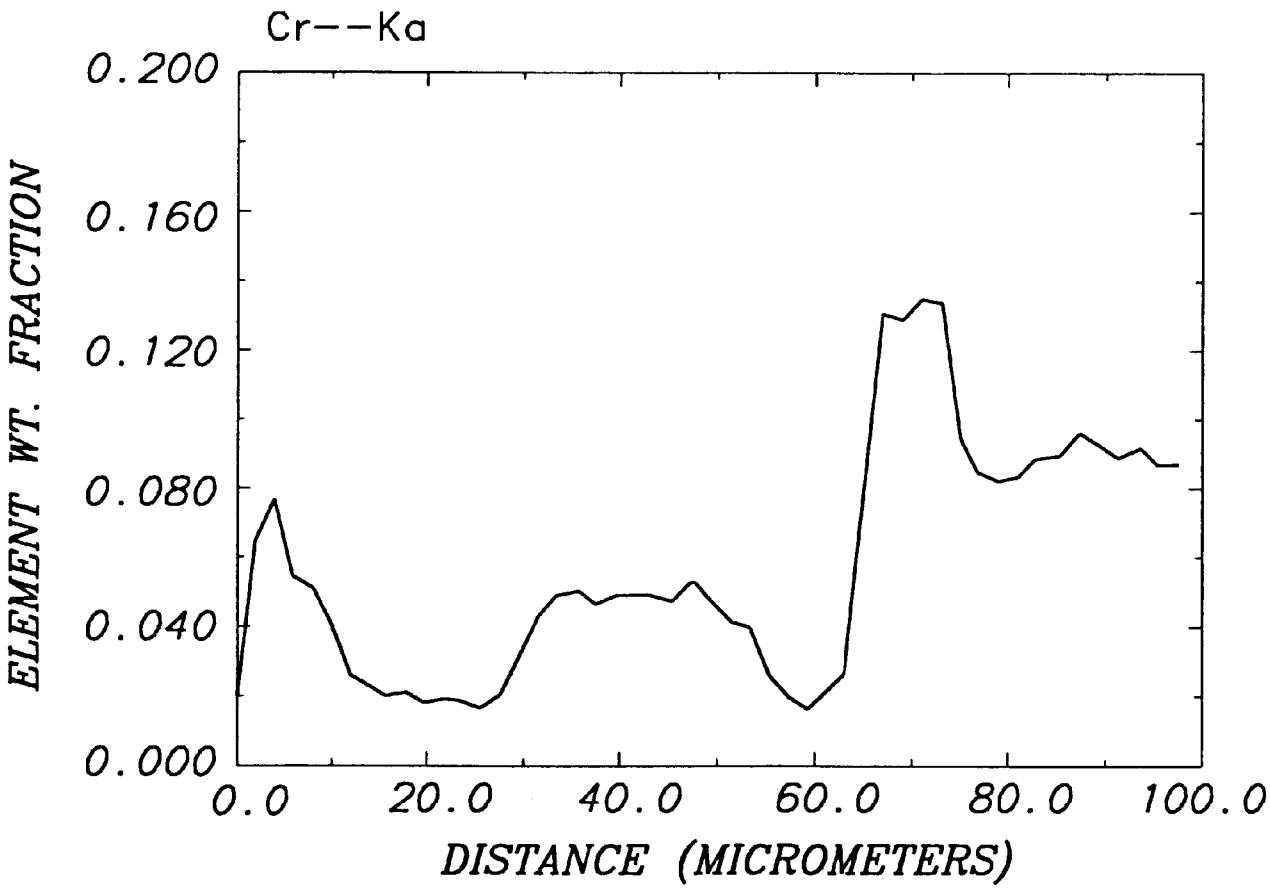
FIG. 8 shows an electron microprobe trace of the distribution of chromium (Cr) in the coating of this invention shown in FIG. 6.
Figure 9:
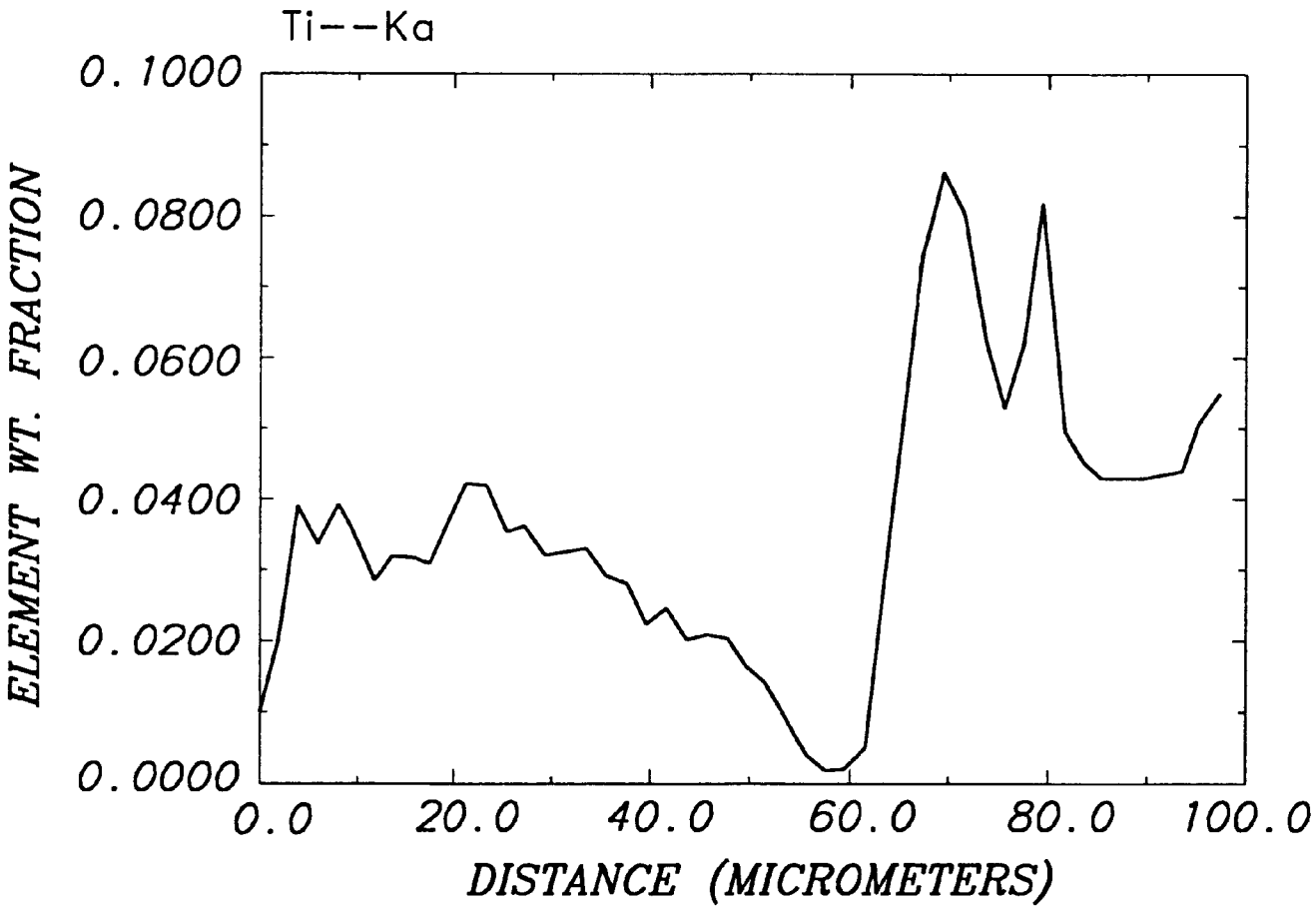
FIG. 9 shows an electron microprobe trace of the distribution of titanium (Ti) in the coating of this invention shown in FIG. 6.
Figure 10:
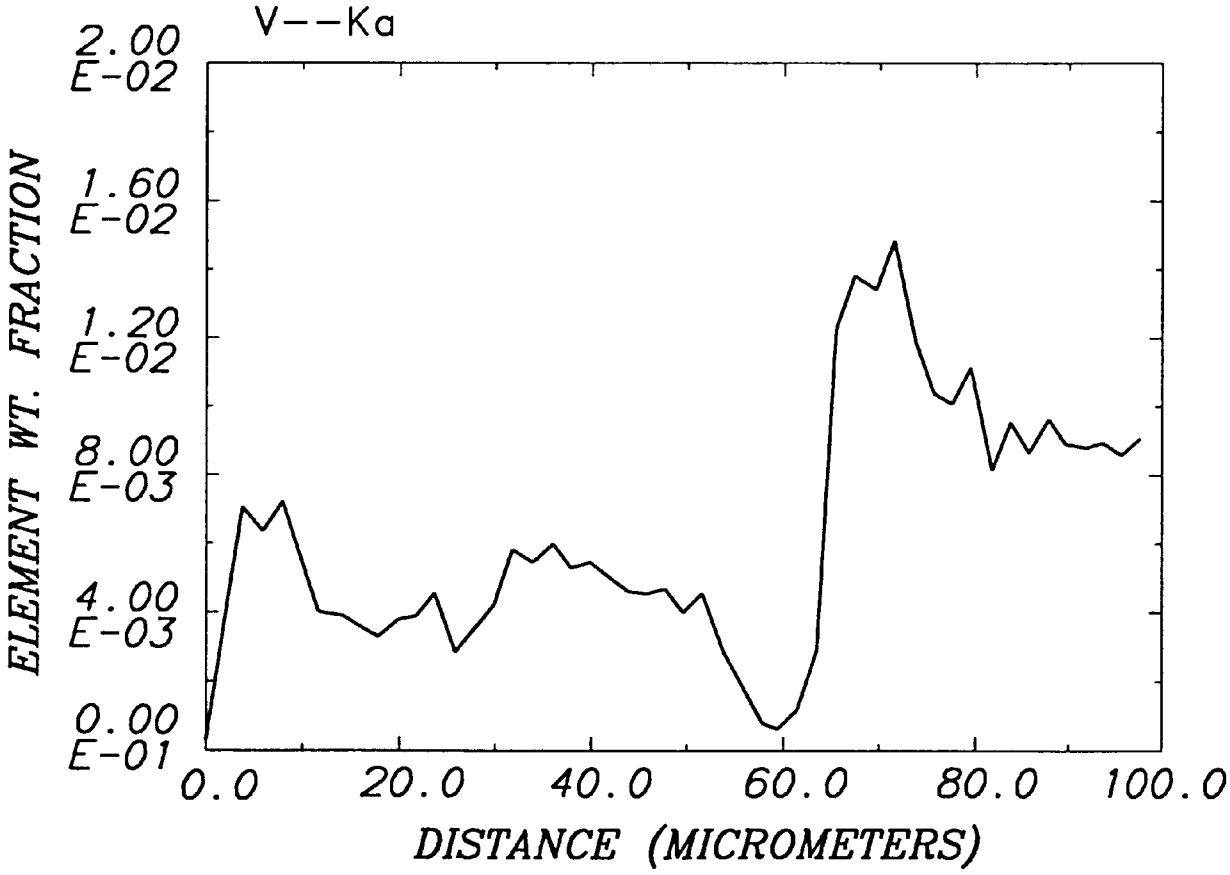
FIG. 10 shows an electron microprobe trace of the distribution of vanadium (V) in the coating of this invention shown in FIG. 6.
Figure 11:
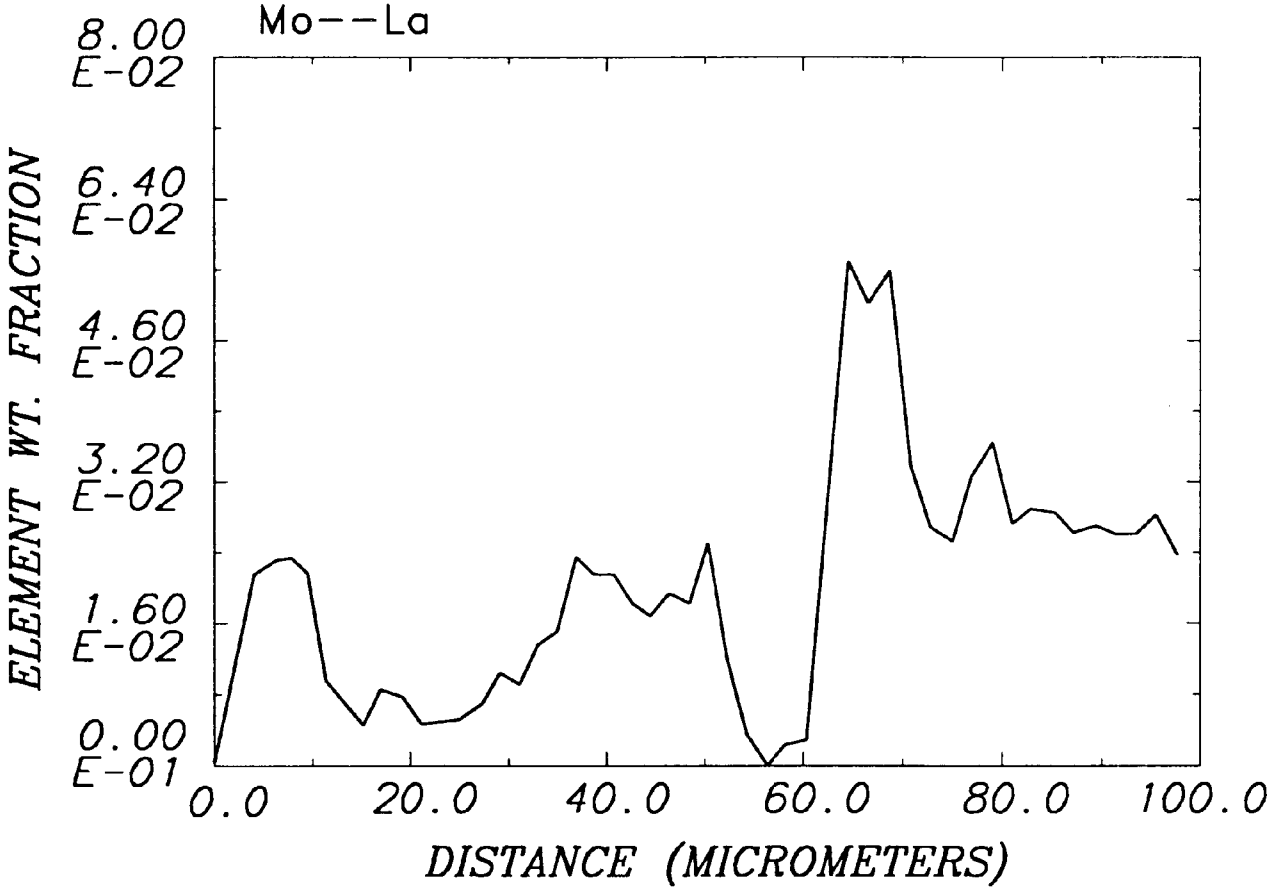
FIG. 11 shows an electron microprobe trace of the distribution of molybdenum (Mo) in the coating of this invention shown in FIG. 6.

FIG. 6 shows a representative microstructure of the coating of this invention on IN100 nickel-base alloy. Electron probe microanalysis of the structure in FIG. 6 shows that the phase, identified as $PtAl_2$, is dispersed throughout the NiAl matrix. It is known in the art that a discontinuous distribution of $PtAl_2$ is desirable in a protective aluminide. Microanalysis of the distribution of silicon, chromium and other refractory metals (FIGS. 7 through 11), demonstrate the affiliation of Cr, Ti, V and Mo with Si within the coating microstructure.

Because hot corrosion and oxidation resistance of a coating of this invention does not depend solely upon formation of layered chromium silicides, its performance is not a function of the chromium content of the substrate as is the performance of other silicon-modified slurry aluminides.

Scavenging deleterious refractory elements from platinum and nickel aluminides in the coating layer more than offsets the lower population of chromium suicides that form on low chromium alloys.

Consequently, oxidation and corrosion resistance of a coating of this invention is enhanced above that realized in a platinum aluminide without simultaneous reaction with silicon. Similarly, resistance to oxidation and hot corrosion of a coating of this invention is enhanced above that realized in an aluminum-silicon slurry aluminide without addition of platinum.

It is within the scope of this invention that platinum enrichment of the nickel alloy be accomplished by first electrolytically depositing a layer of platinum on the surface of the part. This layer should be uniformly dense and well adhered, ranging in average thickness from about 1 to about 15 $\mu$m. Because of the high cost of platinum, it is desirable to minimize the thickness of the platinum coating, while providing the desired improvement to corrosion resistance. A preferred range for the coating thickness is from about 3 to about 7 $\mu$m, particularly from about 3 to about 5 $\mu$m. A further aspect of the present invention is that good coatings can be obtained when the platinum thickness is as little as from about 1 to about 2 $\mu$m thick. The platinum plating should subsequently be diffused at a temperature and time sufficient to alloy the platinum into the surface, preferably above about 1000° C. (1835° F.) for about 20 minutes or more.

It is also within the scope of this invention that a suitable amount of platinum could be deposited by suitable diffusion heat treatment of a slurry containing platinum and/or platinum alloy powder. Platinum could also be incorporated by transient liquid phase deposition from a slurry or electrophoretic deposit of a low melting point, platinum-rich alloy powder.

One embodiment of the coating of this invention is that a slurry comprising aluminum and silicon in a suitable binder is diffused into a nickel alloy that has been enriched with platinum. The slurry comprises metallic powder in elemental form in a binder liquid. The metal powder component of this slurry comprises powders of aluminum and silicon. The concentration of metallic silicon powder may range from about 2 to about 40% of the total weight of aluminum and silicon in the slurry, with particularly good results obtained using ranges of from about 3 to about 25%, from about 5 to about 20%, and from about 10 to about 15%.

The slurry is applied to the platinum-enriched substrate to a thickness sufficient to deposit an effective amount of aluminum and silicon after curing. Slurry thicknesses of about 15 to about 25 mg/cm$^2$ have been found to be effective in the process of the present invention, resulting in final coating thicknesses of about 30 to about 60 $\mu$m. When the total solids content of the slurry is about 60% by weight, good results are obtained by applying about 15 to about 18 mg/cm$^2$ of the slurry to the substrate, and results in a final coating thickness of about 50 to about 60 $\mu$m.

The final coating may be of a thickness ranging from about 10 to about 100 $\mu$m thick. Thinner coatings may not provide the desired corrosion resistance. Thicker coatings may also be used, but the additional cost of such coatings may not result in any additional improvement in corrosion resistance.

Optionally, other elemental metal powder components, including Cr, Ti, Ta and B, may be added to the slurry. When present, Cr is preferably present in an amount of 0 to about 20%, particularly about 2.5 to about 20%, and more particularly about 3 to about 10%, by weight of the total weight of the metal powder constituents in the slurry. When present in the composition, Ti is preferably present in the amount of 0 to about 10%, particularly about 2 to about 5%; Ta in the amount of 0 to about 10%, particularly about 2 to about 5%; and boron in the amount of 0 to about 2.5%, particularly about 0.5 to about 2%, more particularly about 0.5 to about 1%, all percentages by weight of the total weight of the metal powder constituents in the slurry. Ti and Ta are preferably present together.

From the above, it will be noted that in accordance with the invention, the maximum aluminum content of the metallic powder of the slurry is about 98% with the stated minimum amounts of the other metallic elements. Similarly, the minimum aluminum content is about 34.1% with the stated maximum amounts of the other metallic elements, and assuming Si at 40% of the Al content. Compositions with amounts of metals with depart from the upper and lower limits stated tend not to form coatings with the desired properties. In particular, the lower the aluminum content of the slurry, the more difficult it is to have the aluminum in the coating melt and diffuse readily. Thus, it is preferred to maintain the range of aluminum content as stated.

The metallic components are preferably in the form of powder particles, which should be as fine as possible. Preferably the powder particles are less than about 50 $\mu$m, more preferably less than about 20 $\mu$m, and most preferably less than about 10 $\mu$m in diameter on average.

It is also within the scope of this invention that an aluminum-silicon eutectic alloy powder (for example, Al-11.8% Si) may be substituted for all or some portion of the aluminum and silicon metallic components of the slurry, provided that the total percent of silicon is maintained within the above limits.

The binder used for the aluminum and silicon component in accordance with this invention is a liquid, preferably an aqueous liquid, which cures and/or volatilizes when exposed to temperatures required to diffuse the metallic species into the metal surface, leaving no residue on the resultant coating or if a residue remains, it may be conveniently removed, as is done with other organic residues.

Such binders are known. They may have an acidic, neutral or basic pH. They may be solvent or aqueous based. They may be organic types (such as nitrocellulose or equivalent polymers), inorganic thixotropic sols or one of the class of chromate, phosphate, molybdate or tungstate solutions described in U.S. Pat. Nos. 4,537,632, 4,606,967 and 4,863,516 (Mosser et al.) which are incorporated herein by reference. The binder may also be one of the class of water-soluble basic silicates, which cure to a tightly adherent glassy solid by loss of chemically bonded water.

It is within the scope of this invention to deposit the slurry of aluminum and silicon powders, or alloy powders thereof, by spraying, dipping or brushing the liquid onto the platinum enriched surface. Alternatively, powders may be deposited by electrophoretic means from a suspension of the metallic component in a suitable vehicle. It is also envisioned that the metallic particles may be deposited without need of chemical binder by a thermal spray process in which particles, softened in a flame or plasma, are projected at high velocity onto a surface were they deform upon impact to hold fast. Alternatively, a layer of aluminum and silicon or an alloy thereof could be produced by physical vapor deposition (PVD) or ion vapor deposition (IVD).

The aluminum-rich layer is heated in a non-reactive environment to a diffusion temperature above about 660° C., which is sufficient to melt the aluminum powder, which in turn can dissolve the silicon and any other metallic powders. For nickel-base alloys, this diffusion temperature should be fixed above about 870° C. (1600° F.). Suitable non-reactive environments in which the diffusion may be performed include vacuums and inert or reducing atmospheres. Dry argon, hydrogen, dissociated ammonia or mixtures of argon and hydrogen are representative types of gases suitable for use as non-reactive environments.

It is also within the scope of this invention that the aluminum and silicon may be applied to a platinum-enriched surface by the multiple diffusion process for depositing aluminum and silicon described in PCT patent application Ser. No. PCT/US93/04507, published under International Publication Number WO 93/23247, incorporated herein by reference. In the multiple diffusion process, a coating material comprising aluminum and silicon is applied to a superalloy substrate, diffusion heat treated, and then the application and diffusion steps are repeated at least once more. In accordance with the present invention, the superalloy substrate is first platinum enriched before the application of aluminum and silicon by the multiple diffusion process.

The following examples are illustrative of the invention and are not intended to be limiting.

In the following examples IN738 alloy is used as an example of a "high-chromium" content (>12%) nickel-base superalloy, and IN100 alloy as an example of a "low-chromium" content (<12%) nickel-base superalloy. The nominal compositions for these alloys are:

| Component | IN738 % | IN100 % |
|---|---|---|
| Cr | 16.0 | 9.5 |
| Co | 8.5 | 15.0 |
| C | 0.13 | 0.17 |
| Ti | 3.4 | 4.75 |
| Al | 3.4 | 5.5 |
| Mo | 1.75 | 3.0 |
| W | 2.6 | |
| B | 0.012 | 0.015 |
| Nb | 0.85 | |
| Ta | 1.75 | |
| V | | 1.0 |
| Zr | 0.12 | 0.06 |
| Ni | balance | balance |

EXAMPLE 1

Hot corrosion resistance of the platinum-enriched, silicon-modified aluminide of this invention was compared to that of protective aluminides enriched and/or modified with either platinum or silicon alone in laboratory testing. The coatings were applied to three groups of test pins, 6.5 mm diameter by 65 mm long, which were made of IN738 nickel-base superalloy.

Group 1A

The method of this invention was used to produce protective coatings on some of the IN738 pins. These pins were thermally degreased by heating at 343° C. (650° F.) for 15 minutes. The pins were then grit blasted with 120 alumina grit at 40 psi in a suction cabinet. Residual grit was removed by ultrasonic cleaning. The parts were dried, then electroplated with 3 to 5 $\mu$m of platinum. The plated pins were heated in a vacuum of $<10^{-4}$ atm. at 1080° C. for four hours to diffuse the platinum into the nickel alloy.

A thin wet coat of a slurry of aluminum and silicon powder in an aqueous, acidic, chromate/phosphate solution was sprayed onto the plated and diffused pins. The slurry was made up of the following:

| Component | Amount |
|---|---|
| water | 95.0 ml |
| phosphoric acid | 31.5 g |
| chromic acid | 9.0 g |
| magnesium oxide | 7.3 g |
| aluminum powder (<5 $\mu$m diam.) | 82.0 g |
| silicon powder (−325 mesh) | 14.5 g |

This slurry was approximately 60% solids by weight, with silicon comprising about 10% of the total solids, or about 15% of the total weight of the aluminum and silicon powders. The sprayed coat of slurry was dried at 80° C. (175° F.) for 15 minutes, then cured for 30 minutes at 350° C. (650° F.). The slurry could be heated at up to 660° C. (1220° F.), to accelerate the curing process, provided cure was below the melting temperature of aluminum. Lower curing temperatures could also be used, but would required longer cure duration.

When the pins had cooled, a second coat of slurry was sprayed onto the surface, dried and cured as the first. This process was repeated until 15–18 mg/cm$^2$ of a slurry had been applied to each pin. The pins were then heat treated at 885° C. for two hours in a vacuum of $<10^{-4}$ atm. After the parts had cooled, undiffused coating residues were removed by lightly blasting each pin with 90/120 grit alumina at 8–10 psi in a pressure blast cabinet. The resulting platinum-enriched silicon-aluminide coatings were about 60 $\mu$m thick.

A similar coating can be made by admixing 2.5% of powdered Cr to the metallic components of the slurry, these percentages being by weight of the total weight of metal powder constituents in the slurry. Likewise, the slurry can be made with the combination of 2% Ta and 2% Ti, both added as powders. As another example of the present invention, 0.5% powdered boron can be admixed with the metallic components of the slurry.

Group 1B

A second group of identical IN738 pins were coated with a slurry silicon-aluminide. These pins were degreased by heating for 15 minutes at 343° C., then grit blasted with 90/120 alumina grit at 40 psi in a suction cabinet. A thin wet coat of the same aluminum- and silicon-filled chromate/phosphate slurry used in group 1A was sprayed onto the blasted pins. Each coat of slurry was dried at 80° C. for 15 minutes, then cured for 30 minutes at 350° C. This process was repeated until 18–23 mg/cm$^2$ of a slurry had been applied to each pin. The pins were then heated at 885° C. for two hours in a vacuum of $<10^{-4}$ atm. to form the composite aluminide/silicide coating. After the parts had cooled, undiffused residues were removed by lightly blasting each pin with 90/120 grit alumina at 8–10 psi in a pressure blast cabinet. The resulting silicon-modified aluminide coatings were about 75 $\mu$m thick.

Group 1C

A third group of IN738 pins were coated with a platinum-enriched pack aluminide. After being degreased in hot vapor of 1,1,1 trichloroethane, these pins were grit blasted with 320 alumina grit at 15 psi in a pressure cabinet. Residual grit was removed by ultrasonic cleaning, then the pins were electroplated with 3 to 5 $\mu$m of platinum. The plated pins were heated in a vacuum of $<10^{-4}$ atm. at 1080° C. for four hours to diffuse the platinum into the nickel alloy.

The pins were then packed into a mixture of aluminum-12% silicon alloy powder, 120 mesh high purity aluminum oxide grit, and powdered ammonium chloride activator. The mixture, with the pins imbedded in it, was heated to 700–750° C. for approximately two hours to produce a $PtAl_2/Ni_2Al_3$ surface layer. The pins were then removed from the pack mixture and diffusion heat treated at 1080° C. for four hours in inert atmosphere to form a typical platinum aluminide coating containing platinum aluminide and nickel aluminide phases. The coating was 80–90 μm thick.

To compare the relative protection afforded by the various coating systems, sample pins from each of the three groups were placed in a burner rig. In this device, the pins were heated to 875–900° C. within 120 seconds using an air/propane burner, held at that temperature for 10 minutes, then quenched in a spray of 2% sodium sulfate in water. The duration of the spray was adjusted such that 0.150–0.200 mg of sulfate were deposited on each square centimeter per hour. These operating conditions were sufficient to produce (Type I) High Temperature Hot Corrosion attack on the pins.

After 500 to 750 hours in this hot corrosion environment, the extent of attack was determined by metallography. Each pin was sectioned at the location of maximum corrosion. Depth of penetration of the corrosion was measured directly from the polished cross section.

Pins from the Group 1B (coated with the silicon-modified slurry aluminide) experienced corrosion at an average rate of 300–350 hr/mil (12–14 hr/μm) in this laboratory rig test. Pins coated with a platinum-enriched pack aluminide (Group 1C) experienced high temperature corrosion attack at an average rate of 200–250 hr/mil (8–10 hr/μm). Pins protected by a platinum-enriched, silicon-modified slurry aluminide produced by the method of this invention (Group 1A) experienced high temperature corrosion attack at an average rate of 500–750 hr/mil (20–30 hr/μm). These results predict that operating life of parts protected with the coating of this invention would be two to three times that of parts protected by aluminide modified by platinum or silicon alone.

EXAMPLE 2

Testing demonstrated that the hot corrosion resistance of one of the embodiments of the platinum-enriched, silicon-modified aluminide of this invention was uniquely independent of the composition of the nickel alloy substrate. Test pins, 6.5 mm diameter by 65 mm long, were made of IN738, a high chromium content (>12%) nickel-base superalloy, and IN100, a low chromium content (<12%) nickel-base alloy. Pins of each alloy were coated with either a silicon-modified slurry aluminide or a platinum-enriched silicon-aluminide of this invention, formed by diffusing the slurry at 885° C. Pins from each of the four groups were then exposed to High Temperature Hot Corrosion in the laboratory burner test rig described in Example 1.

Group 2A

Burner rig pins of IN738 were coated with 15–18 mg/cm2 of aluminum-silicon slurry and diffused in a vacuum at 885° C. in the same manner described in Group 1B of Example 1.

Group 2B

Burner rig pins of IN100 were coated with 15–18 mg/cm$^2$ of aluminum-silicon slurry and diffused in a vacuum at 885° C. as done for Group 1B of Example 1.

Group 2C

Burner rig pins of IN738 were processed in the same manner as those in Group A of Example 1. The pins were plated with a 3–5 μm layer of platinum and heat treated at 1080° C. for four hours in a vacuum of $<10^{-4}$ atm. After being coated with 15–18 mg/cm$^2$ of aluminum-silicon slurry as described in Example 1, the pins were diffused at 885° C. for two hours in a vacuum of $<10^{-4}$ atm.

Group 2D

Burner rig pins of IN100 were coated with the protective coating of this invention in the same manner described for Group 2C above. Pins were plated with a 3–5 μm layer of platinum and heat treated at 1080° C. for four hours in a vacuum of $<10^{-4}$ atm. The pins were then coated with 15–18 mg/cm$^2$ of an aluminum-silicon slurry of the type in Example 1 and diffused at 885° C. for two hours in a vacuum of $<10^{-4}$ atm.

The thicknesses of the protective coatings on all the pins in these four groups ranged from 50–60 μm. Samples from each group were exposed to High Temperature Hot Corrosion in the laboratory burner rig described in Example 1. As in that case, the extent of attack was determined by metallography at the end of the test. Each pin was sectioned at the location of maximum corrosion. Depth of penetration of the corrosion was measured directly from the polished cross section. The results of this analysis are shown in Table 1.

TABLE 1

HOT CORROSION RESISTANCE OF COATINGS PRODUCED BY ALUMINIZING NICKEL ALLOYS AT 885° C.

| Group | Hot Corrosion Resistance (Average) |
|---|---|
| slurry aluminide modified with silicon only | |
| 2A (IN738) | 300–350 hr/mil (12–14 hr/μm) |
| 2B (IN100) | 150–200 hr/mil (6–10 hr/μm) |
| platinum-enriched and silicon-modified slurry aluminide | |
| 2C (IN738) | >500 hr/mil (20 hr/μm) |
| 2D (IN100) | >500 hr/mil (20 hr/μm) |

Coatings of this invention (Groups 2C and 2D) exhibited greater resistance to hot corrosion attack than did the silicon-modified aluminides which were not enriched with platinum (Groups 2A and 2B). Comparison of the relative performance of the silicon-modified slurry aluminide on the low and high chromium alloys (e.g. pins of group 2A with those of group 2B), demonstrates that, for that coating, hot corrosion resistance is very much a function of the chromium content of the substrate. However, the performance of the coating of this invention was uniquely independent of substrate composition. Hot corrosion resistance of the coating of this invention produced by diffusing the Al/Si slurry at 885° C. for two hours was identical whether the coating was applied to the high chromium alloy, IN738 (group 2C) or the low chromium alloy, IN100 (group 2D).

EXAMPLE 3

An embodiment of the coating of this invention was produced by diffusing aluminum/silicon slurry into a platinum-enriched nickel alloy surface at a temperature above 1000° C. Testing demonstrated that the hot corrosion resistance of this platinum-enriched, silicon-modified aluminide was independent of the composition of the nickel alloy substrate, as was that produced at lower aluminizing temperature (as in Example 2).

Test pins, 6.5 mm diameter by 65 mm long, made of IN738 (16% chromium) and IN100 (10% chromium) nickel-base superalloy were coated with either a silicon-modified slurry aluminide or a platinum-enriched silicon-aluminide of this invention, formed by diffusing the slurry at 1050° C. Pins from each of the four groups were then exposed to High Temperature Hot Corrosion testing similar to that described in Example 1.

Group 3A

Burner rig pins of IN738 were coated with 15–18 mg/cm2 of aluminum-silicon slurry of the type described in Example 1 and diffused at 1050° C. for two hours in a vacuum of $<10^{-4}$ atm.

Group 3B

Burner rig pins of TN100 were coated with 15–18 mg/cm$^2$ of aluminum-silicon slurry of the type in Example 1 and diffused at 1050° C. for two hours in a vacuum of $<10^{-4}$ atm.

Group 3C

Burner rig pins of IN738 were plated with a 3–5 $\mu$m layer of platinum which was diffused into the nickel alloy at 1080° C. for four hours in a vacuum of $<10^{-4}$ atm. The pins were then coated with 15–18 mg/cm$^2$ of the aluminum-silicon slurry described in Example 1. One embodiment of the coating of this invention, different from that described in Example 2, was produced by diffusing the slurry into the platinum-enriched surface at 1050° C. for two hours in a vacuum of $<10^{-4}$ atm.

Group 3D

An embodiment of the coating of this invention was applied to burner rig pins made of IN100 in the same manner used for Group 3C of this invention. The pins were plated with a 3–5 $\mu$m layer of platinum, which was diffused 1080° C. for four hours in a vacuum of $<10^{-4}$ atm. The pins were then coated with 15–18 mg/cm$^2$ of the aluminum-silicon slurry described in Example 1 and diffused at 1050° C. for two hours in a vacuum of $<10^{-4}$ atm.

The thicknesses of the protective coatings on all the pins in these four groups ranged from 50–60 $\mu$m. Samples from each group were exposed to high temperature hot corrosion (HTHC) in the laboratory burner rig described in Example 1. As in that case, the extent of attack was determined by metallography at the end of the test. Each pin was sectioned at the location of maximum corrosion. Depth of penetration of the corrosion was measure directly from the polished cross section. Results of this analysis are shown in Table 2.

TABLE 2

HOT CORROSION RESISTANCE OF COATINGS PRODUCED BY ALUMINIZING NICKEL ALLOYS AT 1050° C.

| Group | Hot Corrosion Resistance (Average) |
|---|---|
| slurry aluminide modified with silicon only | |
| 3A (IN738) | 200–250 hr/mil (8–10 hr/$\mu$m) |
| 3B (IN100) | 100–150 hr/mil (4–6 hr/$\mu$m) |
| platinum-enriched and silicon-modified slurry aluminide | |
| 3C (IN738) | >500 hr/mil (20 hr/$\mu$m) |
| 3D (IN100) | >500 hr/mil (20 hr/$\mu$m) |

The coating of this invention produced by slurry aluminizing at 1050° C. exhibited greater resistance to hot corrosion attack than did the silicon-modified aluminides which were not enriched with platinum (Groups 3A and 3B). Comparison of the relative performance of the slurry aluminide modified with silicon only and diffused at this high temperature on the low and high chromium alloys (e.g. pins of group 3A with those of group 3B), demonstrates that, for that coating, hot corrosion resistance is very much a function of the chromium content of the substrate. However, hot corrosion resistance of the coating of this invention produced by diffusing the Al/Si slurry at 1050° C. for two hours was identical whether the coating was applied to the high chromium alloy, IN738 (group 3C) or the low chromium alloy, IN100 (group 3D). This behavior is identical to that demonstrated in Example 2 above, in which a coating of the invention was produced on nickel alloys of varying chromium contents by slurry aluminizing at a much lower temperature.

EXAMPLE 4

Burner rig specimens of IN100 were electroplated with 1–1.5 $\mu$m of platinum and diffused at 1080° C. for four hours in a vacuum of $<10^{-4}$ atm. These platinum-enriched pins were coated with an aluminum-silicon slurry and diffused at 885° C. to produce one embodiment of the protective coating of this invention. A second set of IN100 pins were coated with the embodiment of the coating of this invention described in Group 2C of Example 2, that is, 3–5 $\mu$m thick. The only difference between the coatings on these two sets of specimens was the thickness of the platinum plating applied during processing.

These pins, coated with two embodiments of the platinum-enriched silicon-modified aluminide of this invention, were then exposed to HTHC tests as described in Examples 1, 2 and 3. After 500 hr, the specimens were sectioned and polished to measure the depth of high temperature hot corrosion attack. The average rate of corrosion attack was determined to be greater than 500 hr/mil (20 hr/$\mu$m) for both coatings. Corrosion resistance was essentially identical, though one coating contained one third the platinum enrichment of the other.

EXAMPLE 5

Pins of IN738 were plated with platinum and diffused as in Example 1 above. These pins were coated with a slurry:

60. ml water
2.5 g colloidal silica
0.5 g colloidal alumina
20. g aluminum powder (<325 mesh)
2. g silicon powder (<200 mesh)

The colloidal oxides were dispersed in the water by stirring, then the aluminum and silicon powders were added to form a slurry which could be applied to the parts by brushing or spraying. In this example, 20–25 mg of this slurry were applied to each square centimeter of the nickel alloy surface. The pins were then diffused at 885° C. for two hours in an inert atmosphere of purified argon gas. Upon cooling, undiffused residues were removed by lightly blasting the surface with 120 grit alumina at 20 psi in a suction blast cabinet. The resultant coatings were 50–60 $\mu$m thick, with a structure analogous to that produced by the chromate/phosphate slurry described in Group 1A of Example 1.

A comparable coating can be generated when the aluminum and the silicon powder are replaced by an equivalent amount of a eutectic alloy powder.

EXAMPLE 6

Pins of IN738 were plated with platinum and diffused as in Example 1 above. These pins were then coated with a slurry made by combining the following two, fully mixed, components:

Part 1

470 ml Ciba Araldite GY 6010, bisphenol A epoxy 365 g xylene 83 g propylene glycol methyl ether acetate 1400 g Valimet Al/11.8% Si eutectic alloy powder (−325 mesh)

10 g Bentone organophillic clay 3 g Troythix 42BA thickener

Part 2

615 ml Ciba HZ 815 X-70 polyamide hardener

After the components in Part 1 had been thoroughly mixed together, Parts 1 and 2 were mixed to form a thick slurry. About 20 mg of this organic slurry were brushed onto each square centimeter of the platinum-enriched nickel alloy surface. The pieces were then diffused at 885° C. for two hours in an inert atmosphere of purified argon gas. Upon cooling, undiffused residues were removed by lightly blasting the surface with 120 grit alumina at 20 psi in a suction blast cabinet. The resultant coatings were 30–40 μm thick, with a structure analogous to that produced by the chromate/phosphate slurry described in Group 1A of Example 1.

EXAMPLE 7

This example demonstrates the improved oxidation resistance provided by the coatings of the present invention. An IN738 pin was coated according to the embodiment of the invention set forth for Group 3C above, except that the platinum plating layer was 1.5–2 μm instead of 3–5 μm thick. This pin, along with a pin from Group 3A, which was an IN738 pin coated with a silicon modified aluminide, were tested for cyclic oxidation resistance by exposing them to an air-propane burner which produced pin temperatures of about 1100° C. (2000° F.). Each cycle consisted of exposure to the burner for ten minutes and then cooling in air for ten minutes. After 560 hours the pin from Group 3A was removed, and after 1020 hours the pin from the platinum-enriched silicon modified aluminide was removed. The pins were sections at the location of maximum attack, and the remaining coating thickness was measured metallographically. The Group 3A silicon aluminide coating recession rate was about 200 hours/mil (8 hours/μm), while the platinum-enriched silicon-modified aluminide coating recession rate was about 500 hours/mil (20 hours/μm).

The above-reported examples were carried out with samples comprising nickel-base alloys. The coating methods and coatings of the present invention may also be applied to cobalt-base alloys to provide improved oxidation and corrosion resistance, in the same manner as for nickel-base alloys.

We claim:

1. A method for forming a coating relatively free as compared to a non-coated superalloy, of deleterious refractory substrate metals on a platinum-enriched surface of a nickel- and chromium-based superalloy of at least three distinguishable layers in the coating in a continuum of nickel aluminide therein, which coating comprises platinum and nickel aluminide layers relatively free of such deleterious refractory metals which method comprises depositing and curing a slurry of aluminum and silicon powders onto the platinum-enriched nickel- and chromium-based superalloy substrate and heating said slurry on the substrate, at a temperature higher than the melting temperature of the aluminum, whereby the silicon dissolves into the molten aluminum, and diffusing simultaneously, at least once, the aluminum and silicon into the superalloy substrate, whereby the aluminum diffusing into the substrate from the molten slurry reacts with nickel and platinum to form intermetallic aluminides and the silicon reacts to form stable silicides with refractory metals of the substrate, thus forming a continuum of nickel aluminides having at least three distinguishable layers, including a first, surface, layer comprising refractory metal silicide phases and a discontinuous distribution of intermetallic aluminides of platinum ($PtAl_2$) and of nickel (NiAl) phases and further whereby the molten silicon scavenges the refractory metals from the platinum and the nickel aluminide phases thus forming below the surface layer a second layer below the surface layer of a discontinuous distribution of refractory silicide phases in the nickel aluminide continuum, this layer being comparatively free of platinum aluminide as compared to the surface layer, and forming a third layer below the second layer which is comparatively free of both platinum aluminide and refractory silicide phases as compared to the surface and second layers, thereby forming a coating of at least three distinguishable layers in a continuum of nickel aluminide, in which the deleterious refractory metals scavenged from the platinum and nickel aluminide phases are concentrated within the silicide layers in the surface and second layers which contribute to the overall hot corrosion resistance of the coating layer.

2. The method of claim 1 whereby the coating which is produced is evidences the property of being high-temperature corrosion resistant which property is essentially independent of the chromium content of the substrate whether above or below 12% chromium.

3. The method of claim 2 wherein the temperature of diffusion of the slurry containing the aluminum is higher than 660° C.

4. The method of claim 3 wherein the temperature of diffusion is in the range of 870° C. to 1050° C.

5. The method of claim 2 wherein the aluminum and silicon in the slurry is a metallic powder of elemental aluminum and silicon.

6. The method of claim 5 wherein the maximum aluminum content of the metallic powder of the slurry is about 98% and the minimum is about 34%.

7. The method of claim 2 wherein the slurry is in an aqueous liquid which cures and/or volatilizes at the diffusion temperature of the metals into the substrate.

8. The method of claim 2 wherein the simultaneous diffusion of the aluminum and the silicon is performed in a vacuum, an inert or a reducing atmosphere.

9. The method of claim 2 wherein the aluminum and silicon in the slurry is in part or all an aluminum-silicon eutectic alloy powder.

10. The method of claim 9 wherein the percentage of silicon in the slurry is between 2 and 40% of the total weight of aluminum and silicon in the slurry.

11. The method of claim 2 wherein the slurry also comprises elemental powder metals selected from the group consisting of chromium, tantalum, titanium, and boron.

12. The method of claim 2 wherein the diffusion step of the molten aluminum and silicon is repeated several times with curing between applications.

13. The method of claim 2 wherein the coating is about 10 to 100 μm thick.

14. The method of claim 2 wherein the portion of the coating deeper than about 75 μm from the surface of the coating is substantially free of silicon.

15. The method of claim 2 wherein the wherein the deleterious refractory metals are selected from the group of elements consisting of chromium, titanium, tungsten, molybdenum, vanadium, niobium, tantalum, hafnium, and rhenium.

16. The method of claim 2 wherein the superalloy comprises chromium dispersed throughout the coating.

17. The method of claim 2 wherein the nickel- and chromium-based superalloy is a low chromium content alloy with a chromium content of less than 12%.

18. The method of claim 2 wherein the nickel- and chromium-based superalloy is a high chromium content alloy with a chromium content of more than 12%.

19. The method of claim 2 wherein the slurry is applied by spraying, electroplating, dipping, or brushing onto the superalloy substrate.

20. The method of claim 2 wherein the coating is applied to a part of the substrate.

21. The method of claim 2 wherein the method is to repair imperfections and touch up a metal substrate part.

22. The method of claim 1 wherein the temperature of diffusion of the slurry containing the aluminum is higher than 660° C.

23. The method of claim 1 wherein the aluminum and silicon in the slurry is a metallic powder of elemental aluminum and silicon.

24. The method of claim 23 wherein the maximum aluminum content of the metallic powder of the slurry is about 98% and the minimum is about 34%.

25. The method of claim 1 wherein the slurry is in an aqueous liquid which cures and/or volatilizes at the diffusion temperature of the metals into the substrate.

26. The method of claim 1 wherein the simultaneous diffusion of the aluminum and the silicon is performed in a vacuum, an inert or a reducing atmosphere.

27. The method of claim 1 wherein the aluminum and silicon in the slurry is in part or all an aluminum-silicon eutectic alloy powder.

28. The method of claim 1 wherein the slurry also comprises elemental powder metals selected from the group consisting of chromium, tantalum, titanium, and boron.

29. The method of claim 1 wherein the diffusion step of the molten aluminum and silicon is repeated several times with curing between applications.

30. The method of claim 1 wherein the wherein the deleterious refractory metals are selected from the group of elements consisting of chromium, titanium, tungsten, molybdenum, vanadium, niobium, tantalum, hafnium, and rhenium.

31. The method of claim 1 wherein the nickel- and chromium-based superalloy is a low chromium content alloy with a chromium content of less than 12%.

32. The method of claim 1 wherein the nickel- and chromium-based superalloy is a high chromium content alloy with a chromium content of more than 12%.

33. The method of claim 1 wherein the slurry is applied by spraying, electroplating, dipping, or brushing onto the superalloy substrate.

34. The method of claim 1 wherein the coating is applied to a part of the substrate.

35. The method of claim 1 wherein the method is to repair imperfections and touch up a metal substrate part.

* * * * *